US007225821B2

(12) United States Patent
Su

(10) Patent No.: US 7,225,821 B2
(45) Date of Patent: Jun. 5, 2007

(54) UMBRELLA STRUCTURE

(76) Inventor: Ping-Tung Su, P.O. Box No. 6-57, Junghe, Taipei 235 (TW)

( * ) Notice: Subject to any disclaimer, the term of this patent is extended or adjusted under 35 U.S.C. 154(b) by 206 days.

(21) Appl. No.: 10/787,090

(22) Filed: Feb. 27, 2004

(65) Prior Publication Data

US 2005/0189007 A1 Sep. 1, 2005

(51) Int. Cl.
*A45B 25/08* (2006.01)

(52) U.S. Cl. ..... 135/38; 135/28

(58) Field of Classification Search ..... 135/28, 135/37–39, 98

See application file for complete search history.

(56) References Cited

U.S. PATENT DOCUMENTS 263,271 A * 8/1882 Whiting ..... 135/38
542,999 A * 7/1895 Douglass ..... 135/98
1,908,210 A * 5/1933 Adler ..... 135/38
4,576,191 A * 3/1986 Schultes et al. ..... 135/39
5,515,878 A * 5/1996 Wu ..... 135/39
5,964,235 A * 10/1999 Wang ..... 135/39
6,539,964 B1 * 4/2003 Ko ..... 135/39
2002/0179130 A1 * 12/2002 Ko ..... 135/39
2003/0183261 A1 * 10/2003 Lee ..... 135/38

* cited by examiner

*Primary Examiner*—Tamara L. Graysay

(57) ABSTRACT

An umbrella structure according to the invention includes a cover, a shaft, a notch, a runner, main ribs and stretchers. The notch is downwardly extended to form an extension section, which is accommodated with the runner and extruded to form an integral elastic protrusion. The protrusion is devised as a fastening button with one end thereof joined with the extension section, and a projecting top portion forming a supporting plane for butting against the runner. When the umbrella is stretched, the supporting plane of the protrusion section is butted against a lower section of the runner to stretch the umbrella.

4 Claims, 8 Drawing Sheets

UMBRELLA STRUCTURE

BACKGROUND OF THE INVENTION (a) Field of the Invention

The invention relates to an umbrella structure, and more particularly, to an umbrella, which overcomes a drawback in a prior invention that is incapable of steadily stretching for use due to a reduced volume of the umbrella.

(b) Description of the Prior Art

Referring to FIGS. 1 and 1A, a prior umbrella 1 comprises a cover 11, a shaft 12, a notch 13, a runner 14, main ribs 15 and stretchers 16. Around the notch 13 is a plurality of pivotally disposed main ribs 15 for supporting the cover 11, whereas around the runner 14 is a plurality of pivotally disposed stretchers 16 for supporting the main ribs 15. The shaft 12 is in a two-sectional or multi-sectional form, and has a top end thereof fixed to the notch 13. The notch 13 is fastened with an inner tube 122, which has a rectangular fastening orifice 121 at an appropriate position for setting free a fastening button 17 disposed at the inner tube 122. The inner tube 122 is also penetrated through the runner 14, so as to allow the runner 14 with up-and-down sliding movements. When the umbrella 1 is stretched, the runner 14 is pushed upward to the fastening button 17 that further butts against a bottom portion of the runner 14, such that the main ribs 15 prop up the entire cover 11. The umbrella 1 is collapsed by pressing the fastening button 17.

As described above, although the prior umbrella 1 fulfills stretching and collapsing functions, a collapsed volume thereof is rather large when the shaft 12 is in two-sectional or multi-sectional form. The collapsed umbrella 1 is only suitable for carrying in larger handbags or backpacks but not in commonly used smaller-sized handbags. To reduce the volume of the umbrella 1, it is necessary to devise the shaft 12 as a multi-sectional design, with a difference between diameters of an outer tube and the inner tube of the shaft 12 being inevitably enlarged. When stretching the umbrella, a substantial space is left between the inner tube having the smallest diameter and the runner 14 having a diameter larger than that of the outer tube, so that undesired wavering and deviation of the runner 14 are produced when the shaft 12 performs up-and-down movements. Hence, the fastening orifice 17 at the shaft 12 becomes incapable of appropriately butting against the runner 14, with the runner 14 frequently sliding downward and failing to steadily stretching the umbrella.

Referring to FIGS. 2 and 2A showing another prior umbrella 2, a shaft 22 is devised as a four-sectional or five-sectional design for reducing the volume of the umbrella 2. As appropriate, one or two ends where stretchers 25 come into contact with a runner 23 are inserted and extended with extension posts 27. When stretching the umbrella 2, the shaft 22 is upheld by the extension posts 27 through the runner 23 to prevent the shaft 22 from producing undesired wavering. A fastening button 26 at the shaft 22 and a bottom portion 28 of the runner 23 allow a larger mutual supporting plane, thereby enabling the stretchers 25 connected with the runner 23 to prop up main ribs 24 that further stretch an entire cover 21. The umbrella 2 is collapsed by pressing the fastening button 26.

As described above, the prior umbrella 2 advances over the prior umbrella 1 by having a smaller volume. However, due to the extension posts 27 in the prior umbrella 2, the runner 23 requires slight turning to allow the fastening button 26 to avoid the extension posts 27 to stretch the umbrella for that the shaft is butted against by the extension posts 27; usage inconveniences of users are again caused.

SUMMARY OF THE INVENTION

In view of the aforesaid drawbacks of prior invention, the primary objective of the invention is to overcome the drawback of failing to steadily stretching the umbrella having a reduced volume using a fastening section and a protrusion section.

The secondary objective of the invention, by utilizing a protrusion at an upper portion of the fastening section and a slot at an inner periphery of the runner, is to prevent chipping and deformation of a runner caused by undesired wavering and deviation of the runner during up-and-down sliding movements of the runner at the fastening section.

An umbrella structure according to the invention comprises a cover, a shaft, a notch, a runner, main ribs and stretchers. The multi-sectional shaft has the notch disposed at a top portion thereof. Around the notch is a plurality of pivotally disposed main ribs for supporting the cover. The notch is downwardly extended to form an extension section, which is accommodated with the runner and extruded to form an integral elastic protrusion. The protrusion is devised as a fastening button with one end thereof joined with the extension section, and a projecting top portion forming a supporting plane for butting against the runner. To stretch the umbrella, the supporting plane of the protrusion section is reliably butted against a lower section of the runner to smoothly stretch the umbrella. Thus, the aforesaid structure is capable of overcoming a drawback as being incapable of steadily stretching the umbrella due to a reduced volume of the umbrella.

DETAILED DESCRIPTION OF THE PREFERRED EMBODIMENTS

Figure 1:
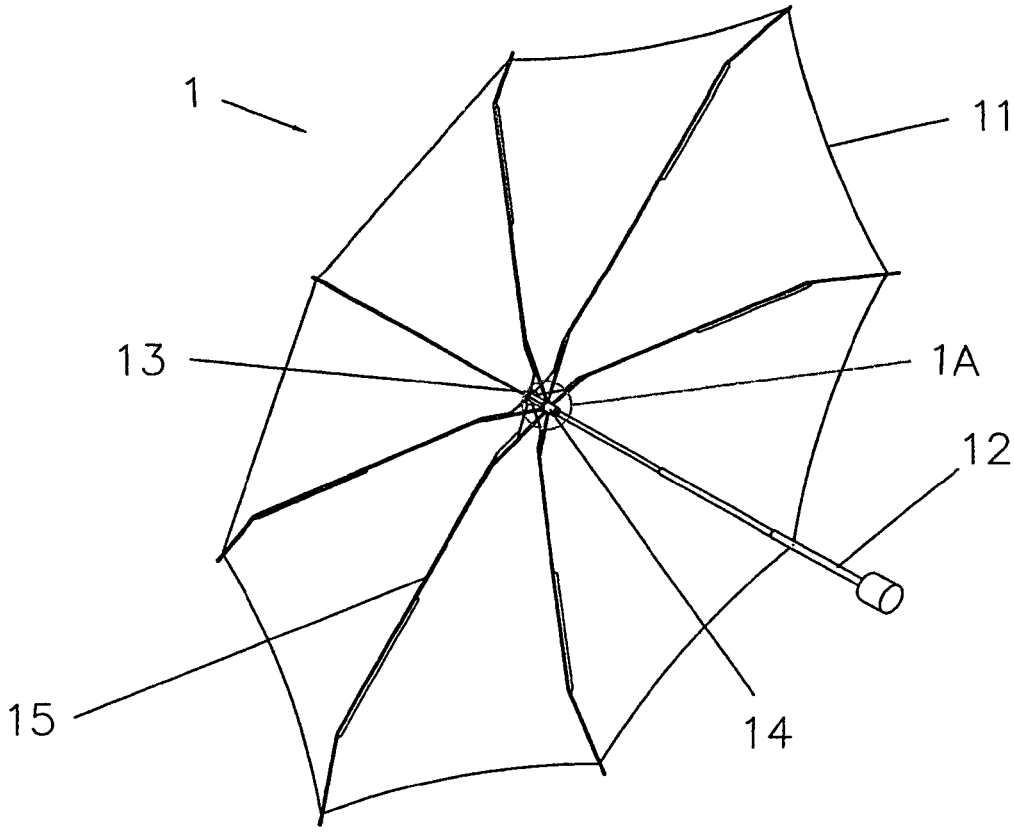
FIG.1 Prior Art
FIG. 1 shows a schematic view of a prior umbrella being stretched.
Figure 1A:
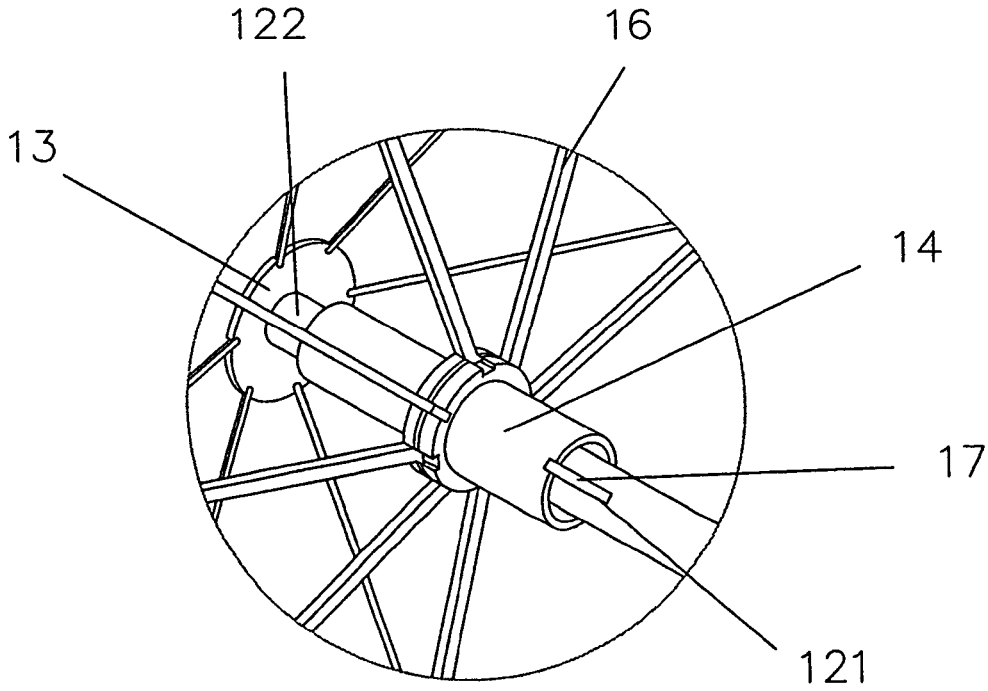
FIG.1A Prior Art
FIG. 1A shows a partial enlarged view of FIG. 1.
Figure 2:
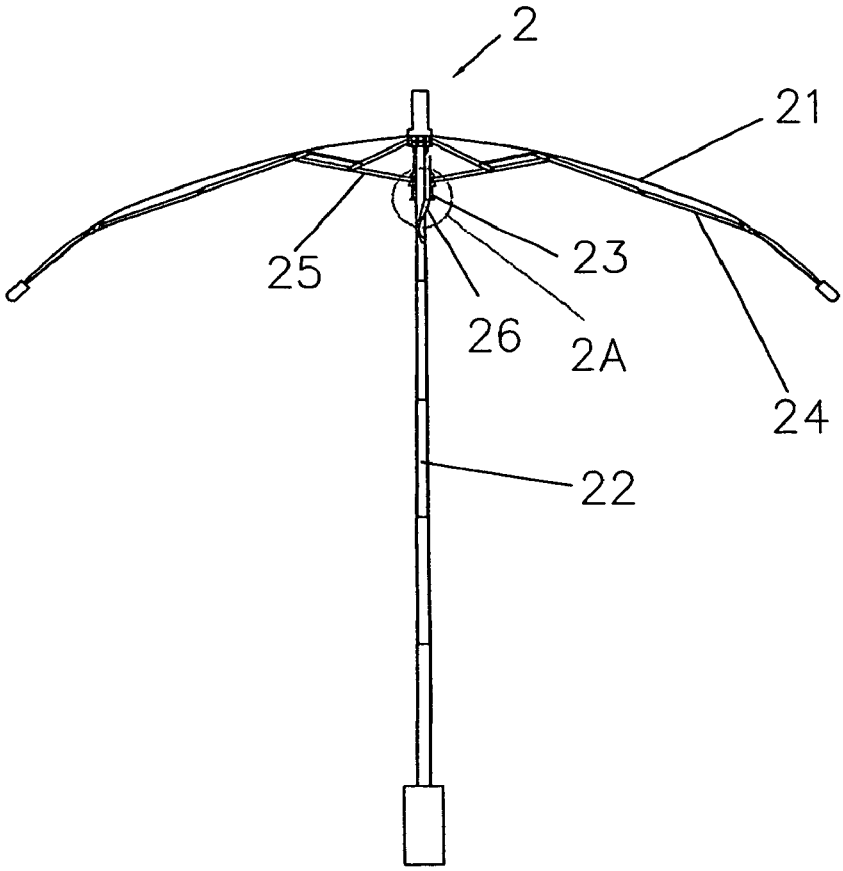
FIG.2 Prior Art
FIG. 2 shows a schematic view of another prior umbrella being stretched.
Figure 2A:
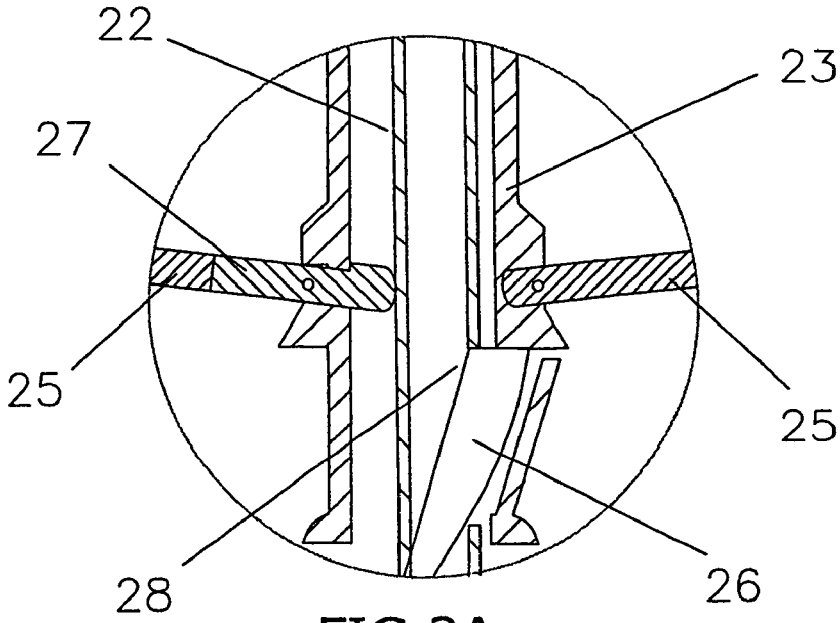
FIG.2A Prior Art
FIG. 2A shows a partial enlarged view of FIG. 2.
Figure 3:
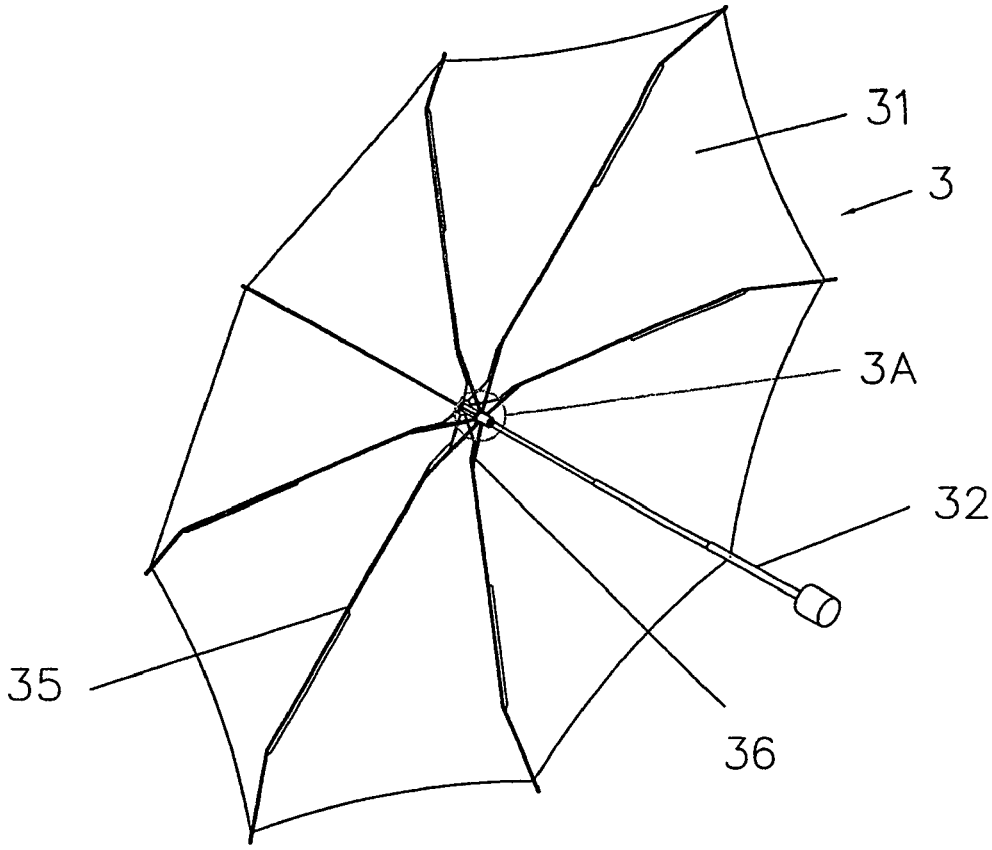
FIG. 3 shows a schematic view illustrating an umbrella according to the invention being stretched.
Figure 3A:
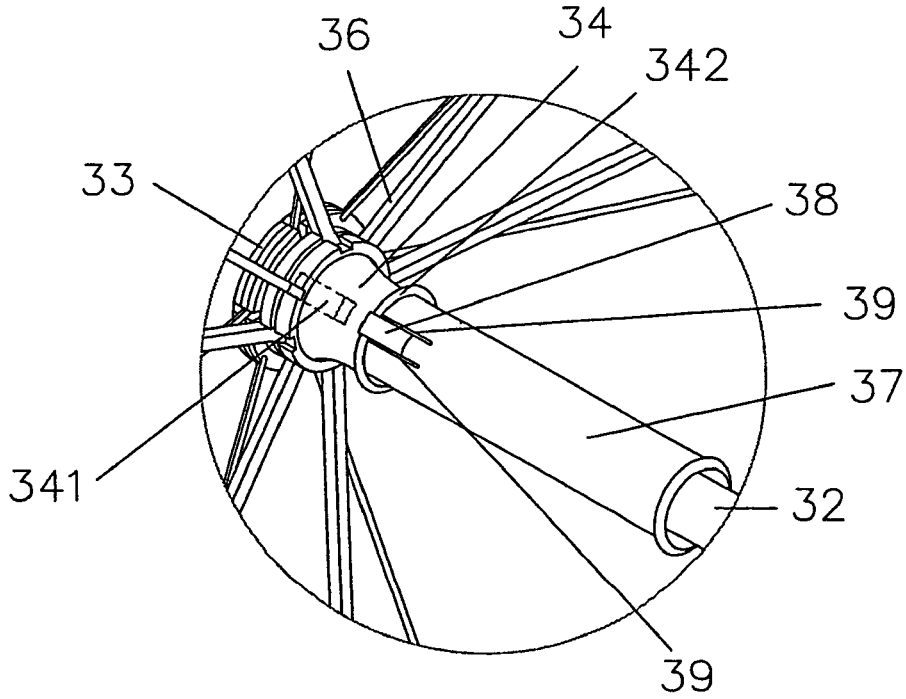
FIG. 3A shows an enlarged partial view of FIG. 3.
Figure 4:
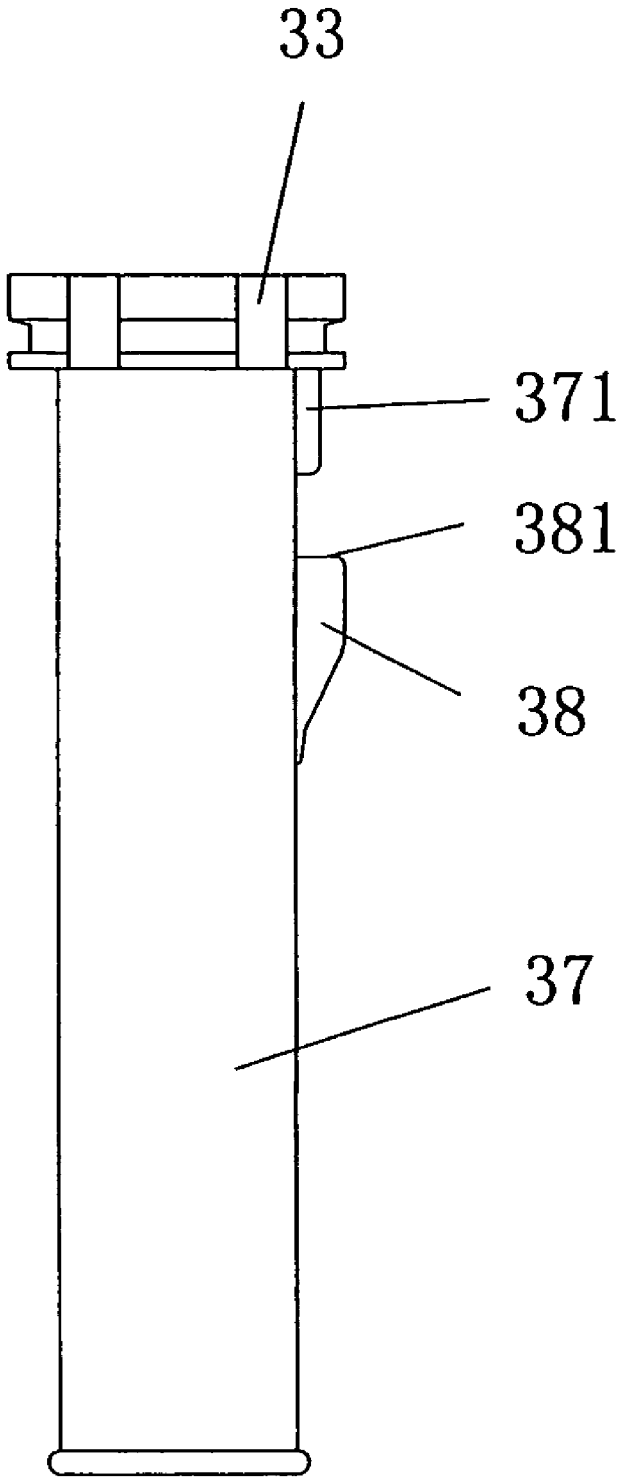
FIG. 4 shows a side schematic view illustrating the extension section and the protrusion section according to the invention.
Figure 5:
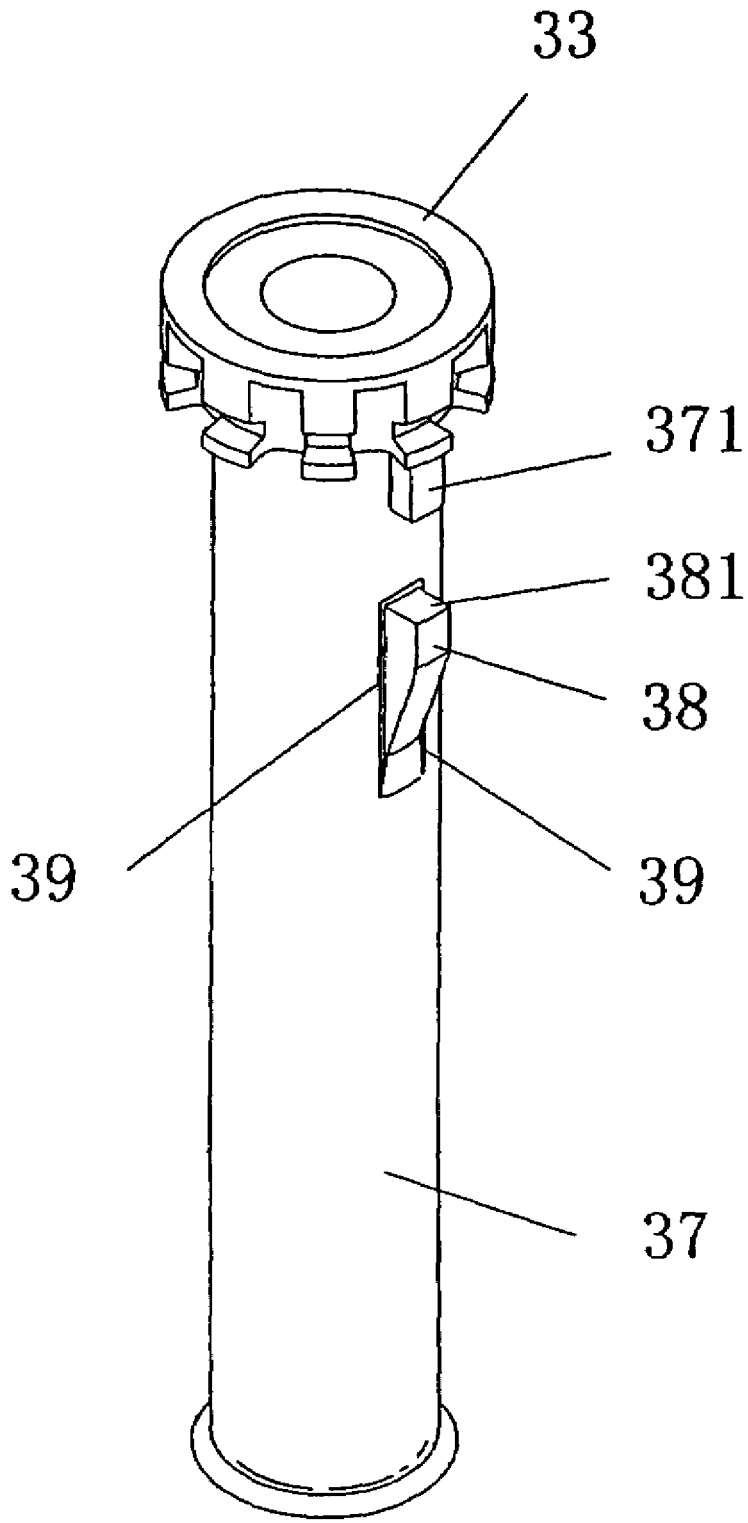
FIG. 5 shows an elevational schematic view illustrating the extension section and the protrusion section according to the invention.

To better understand the functions, structures and characteristics of the invention, detailed descriptions of a preferred embodiment shall be given with the accompanying drawings below.

Referring to FIGS. 3, 3A, 4 and 5, an umbrella 3 according to the invention comprises a cover 31, a shaft 32, a notch 33, a runner 34, main ribs 35 and stretchers 36. The multi-sectional shaft 32 has the notch 33 disposed at a top portion thereof. Around the notch 33 is a plurality of pivotally disposed main ribs 35 for supporting the cover 31. The notch 33 is downwardly extended to form an extension section 37 accommodated by the runner 34. Around the runner 34 is a plurality of pivotally disposed stretchers 36 for supporting the main ribs 35. The extension section 37 is extruded to form an elastic protrusion section 38 in the shape of a fastening button. The protrusion section 38 has a lower end thereof joined with the extension section 37, each of the two sides of protrusion section 38 and the extension section 37 form a gap 39, and a protruding upper portion thereof forming a supporting plane 381 for supporting the runner 34. When the umbrella is stretched, the supporting plane 381 of the protrusion section 38 reliably supports a lower section 342 of the runner 34 to further facilitate stretching the umbrella. Hence, the aforesaid structure is capable of overcoming a drawback as being incapable of steadily stretching the umbrella due to a reduced volume of the umbrella.

According to the aforesaid description, the extension section 37 and the protrusion section 38 are integrally formed. At an appropriate position, the extension section 37 is provided with a longitudinal protrusion 371 axially aligned with the shaft 32, and an inner periphery of the runner 34 is provided with a slot 341 for insetting the protrusion 371, so as to guide the runner 34 for correct up-and-down sliding movements, and to prevent chipping and deformation of the runner 34 by eliminating undesired wavering and deviation of the runner 34 during up-and-down sliding movements.

Figure 6:
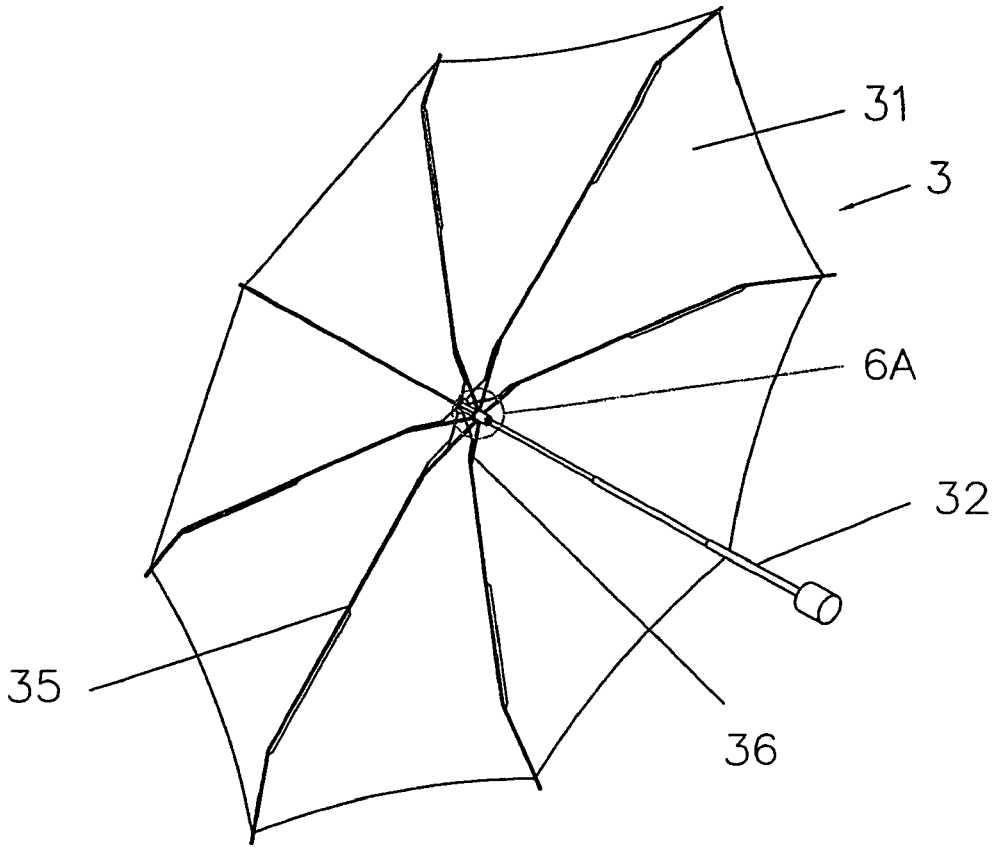
FIG. 6 shows another front schematic view illustrating the fastening section according to the invention.
Figure 6A:
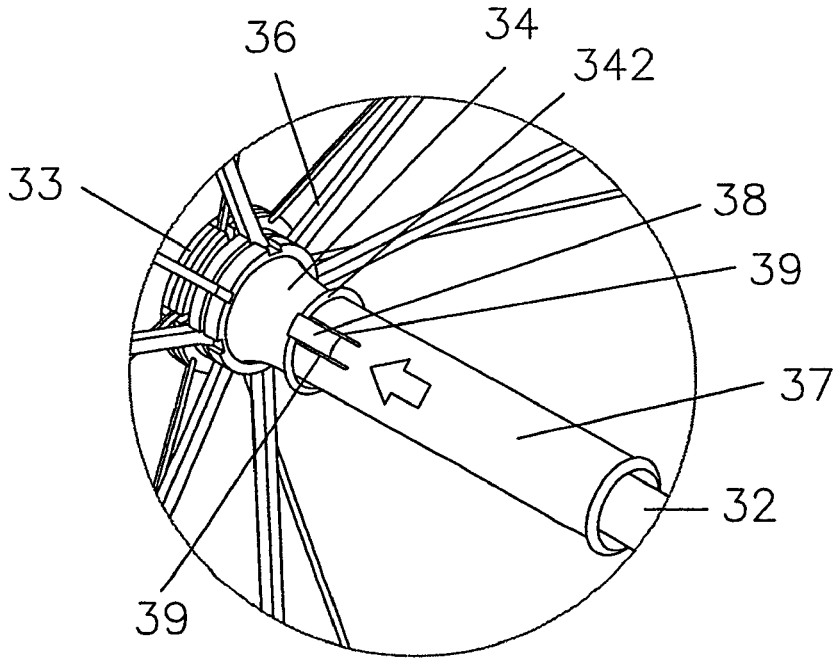
FIG. 6A shows an enlarged partial view of FIG. 6.
Figure 7:
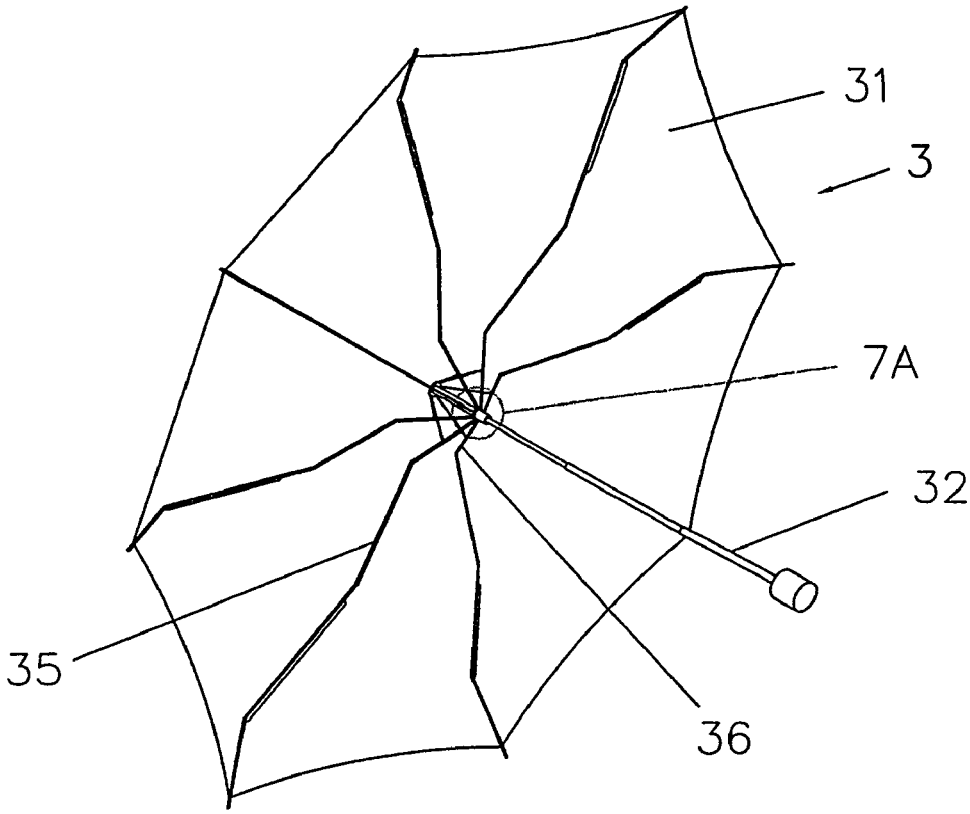
FIG. 7 shows a schematic view illustrating an umbrella according to the invention being collapsed.
Figure 7A:
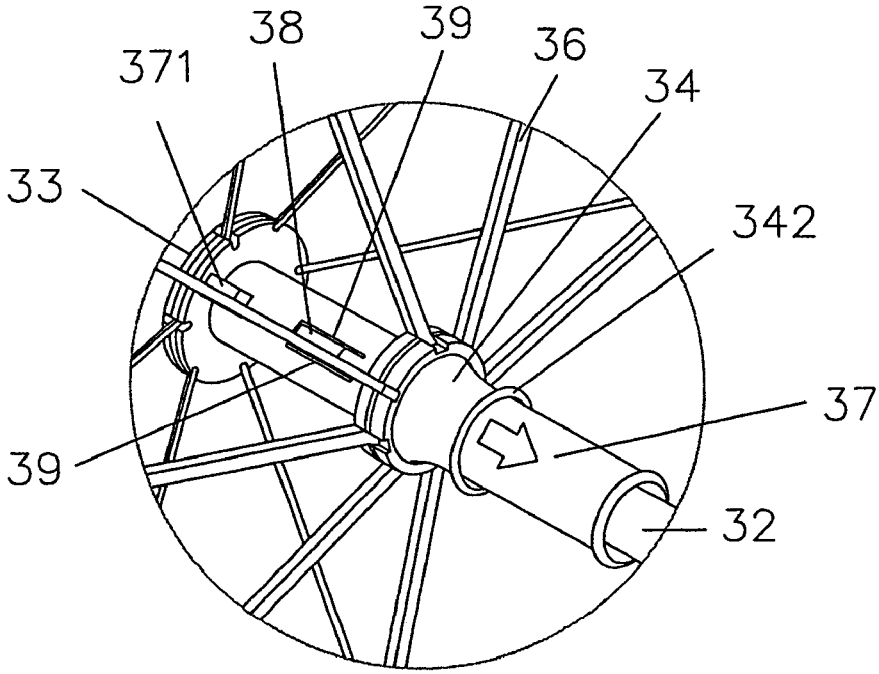
FIG. 7A shows an enlarged partial view of FIG. 7.

Referring to FIGS. 6 and 6A, to stretch the umbrella according to the invention, the runner 34 is pushed upward to reach the protrusion section 38 such that the runner 34 approaches the notch 33. At this point, the supporting plane 381 of the protrusion section 38 is reliably butted against the lower section 342 of the runner 34, so that the stretchers 36 connected with the runner 34 are able to support the main ribs 35 that further prop up the entire cover 31, thereby completing stretching of the umbrella. To collapse the umbrella 3, referring to FIG. 7, the protrusion section 38 is retreated inward by applying force thereon, and the supporting plane 381 is disengaged from the lower section 342 of the runner 34 that is further slid downward. Force applied to the protrusion section 38 is then set free to complete collapsing the umbrella 3.

Figure 8:
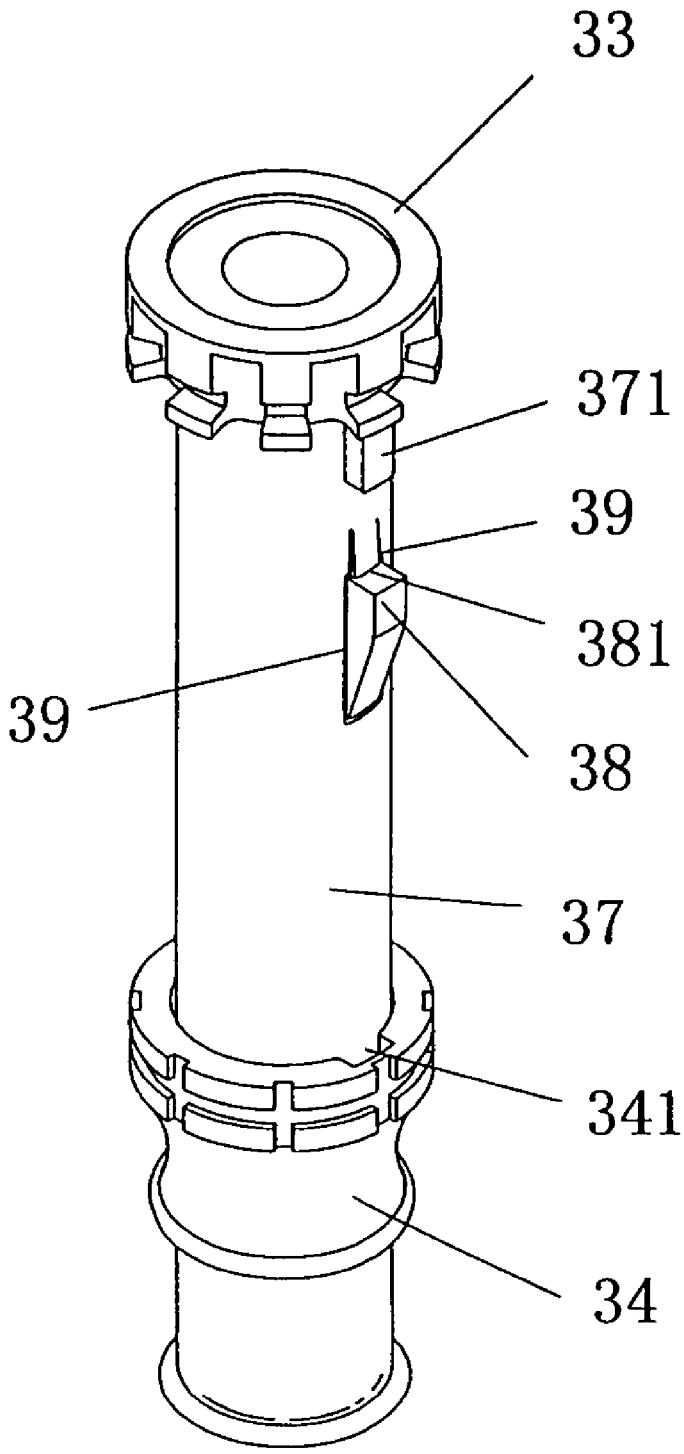
FIG. 8 shows another embodiment according to the invention.

Referring to FIG. 8 showing another embodiment according to the invention, an upper end of the protrusion section 38 is joined with the extension section 37; and is devised as a fastening button and has each of two sides thereof form a gap 39 with the extension section 37.

It is apparent from the above descriptions that, the invention has the excellences below:

1. Using the extension section and the protrusion section, the umbrella according to the invention effectively overcomes the drawback of a prior invention as having a fastening button incapable of butting against the runner and failing to steadily stretch the umbrella due to a reduced volume of the umbrella.
2. Using the protrusion at the upper portion of the fastening section and the slot at the inner periphery of the runner, chipping and deformation of the runner are prevented by eliminating undesired wavering and deviation of the runner during up-and-down sliding movements at the fastening section.

Conclusive from the aforesaid descriptions, the umbrella structure according to the invention offers better practical and economical values comparing to prior inventions. It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An umbrella locking assembly comprising:

a) a multi-sectional shaft;

b) a notch located on a top of the multi-sectional shaft and having an extension section protruding downwardly and having a length surrounding an exterior of the multi-sectional shaft;

c) a plurality of ribs pivotally connected to an outer periphery of the notch and movable between open and closed positions, the plurality of ribs supporting a cover of the umbrella;

d) a protrusion section having:

i) a first end connected to the extension section;

ii) two opposing sides spaced apart from the extension section by gaps formed there between; and iii) a supporting plane located on a second end thereof;

e) a runner slidably located on the extension section; and f) a plurality of stretchers, each of the plurality of stretchers is connected between the runner and a respective one of the plurality of ribs, the plurality of stretchers supporting the plurality of ribs, wherein, when the ribs are located in the open position, the runner is located between the notch and the protrusion section, the plurality of stretchers supporting the plurality of ribs, the supporting plane engaging a lower section of the runner and holding the runner in a predetermined position, and, when the ribs are located on the extension section in the closed position, the runner is located on the extension section below the protrusion section.

2. The locking assembly according to claim 1, wherein the protrusion section and the extension section are integrally formed.

3. The locking assembly according to claim 1, wherein the protrusion section is made as a fastening button.

4. The locking assembly according to claim 1, wherein the runner has a slot and the extension section has a longitudinal protrusion inserted into the slot, when the ribs are located in the open position.

* * * * *